US010247418B2

(12) United States Patent
Bianchi et al.

(10) Patent No.: US 10,247,418 B2
(45) Date of Patent: Apr. 2, 2019

(54) FLAME IGNITION AND CONTROL SYSTEM

(71) Applicant: CASTFUTURA SPA, Milan (IT)

(72) Inventors: Raoul Bianchi, Villa Guardia (IT); Marco Corbella, Fagnano Olona-Bergoro (IT); Mauro Canavesi, Locate Varesino (IT); Marco Colatti, Almenno San Salvatore (IT)

(73) Assignee: CASTFUTURA S.P.A., Terno d'Isola (Bergamo) (IT)

( * ) Notice: Subject to any disclaimer, the term of this patent is extended or adjusted under 35 U.S.C. 154(b) by 563 days.

(21) Appl. No.: 14/355,220

(22) PCT Filed: Nov. 16, 2012

(86) PCT No.: PCT/IB2012/056483
§ 371 (c)(1),
(2) Date: Apr. 30, 2014

(87) PCT Pub. No.: WO2013/076632
PCT Pub. Date: May 30, 2013

(65) Prior Publication Data

US 2014/0302445 A1 Oct. 9, 2014

(30) Foreign Application Priority Data

Nov. 22, 2011 (IT) ..... GE2011A0135

(51) Int. Cl.
*F23N 5/10* (2006.01)
*F23N 5/24* (2006.01)

(52) U.S. Cl.
CPC ..... *F23N 5/102* (2013.01); *F23N 5/10* (2013.01); *F23N 5/107* (2013.01); *F23N 5/242* (2013.01);
(Continued)

(58) Field of Classification Search
CPC .... F23N 2027/28; F23N 2027/36; F23N 5/10; F23N 5/102; F23N 5/107; F23N 5/242
See application file for complete search history.

(56) References Cited

U.S. PATENT DOCUMENTS 2,635,637 A 4/1953 Carrer
3,160,714 A * 12/1964 Else ..... H01H 47/00 335/153

(Continued)

FOREIGN PATENT DOCUMENTS

IT 1270779 B * 5/1997
JP 58178118 10/1983
WO 9312378 6/1993

OTHER PUBLICATIONS

Bucknell, "Temperature Sensor—The Thermocouple", Jan. 26, 2003, https://www.facstaff.bucknell.edu/mastascu/eLessonsHTML/Sensors/TempThermCpl.html.*

*Primary Examiner* — Kenneth Rinehart
*Assistant Examiner* — Logan P Jones
(74) *Attorney, Agent, or Firm* — Themis Law

(57) ABSTRACT

A flame ignition and control system includes at least one gas burner, which is connected to a gas source via a flame control system, and a safety valve controlled by a flame sensor consisting of a thermocouple. The safety valve has an open state, in which the source supplies gas to the burner, and a closed state, in which gas flow is obstructed, the switching from the open state to the closed state and vice versa being controlled by the electric signal generated by the thermocouple. An igniter device is provided, which consists of an ignition electrode and a power supply unit thereof. Furthermore, at least the operation of the igniter device is controlled according to the current strength of the electric signal generated by the thermocouple.

7 Claims, 4 Drawing Sheets

(52) U.S. Cl.
CPC ..... *F23N 2027/28* (2013.01); *F23N 2027/36* (2013.01)

(56) References Cited

U.S. PATENT DOCUMENTS 3,462,233 A * 8/1969 Matthews ..... F23N 5/102 361/102
3,519,376 A * 7/1970 Dietz ..... F23N 5/102 431/43
3,726,630 A * 4/1973 Potts ..... F23Q 3/004 431/254
3,818,285 A * 6/1974 Carson ..... F23N 5/102 307/653
3,836,447 A * 9/1974 Emmons ..... G01N 27/4161 204/272
4,178,579 A * 12/1979 McGibbeny ..... E21B 17/003 307/127
4,318,687 A 3/1982 Inoue
5,403,183 A * 4/1995 Andersson ..... F23D 14/725 431/27
5,924,857 A 7/1999 Frasnetti
5,941,699 A * 8/1999 Abele ..... F23N 5/107 126/92 AC
2002/0172903 A1* 11/2002 Chen ..... F23N 1/007 431/43
2002/0175213 A1* 11/2002 Wodeslavsky ..... F24C 3/126 236/20 A
2007/0003892 A1* 1/2007 Huang ..... F23D 14/28 431/24
2008/0124667 A1* 5/2008 Schultz ..... F23N 1/022 431/18
2010/0282325 A1* 11/2010 Cimino ..... F23N 1/002 137/1
2013/0104814 A1* 5/2013 Reyman ..... F23N 5/242 122/14.21

* cited by examiner

FLAME IGNITION AND CONTROL SYSTEM

FIELD OF THE INVENTION

The present invention relates to a flame ignition and control system, comprising at least one gas burner which gas burner is connected to a gas source via flame control means and a safety valve controlled by a flame sensor consisting of a thermocouple.

The safety valve has an open state, in which the gas source supplies gas to the burner, and a closed state, in which gas flow is obstructed.

Furthermore, an igniter device is provided, which consists of an ignition electrode and power supply means therefor, such that the power supply means send current pulses to the ignition electrode to generate a spark at the burner nozzles.

The thermocouple comprises a first conductor element and a second conductor element, which are in electrically conductive contact at one detection end, known as hot junction, which is obtained by joining a terminal of the first conductor element and a corresponding terminal of the second conductor element, to generate a potential difference at the two free ends of each conductor element, known as cold junction, which is a function of the temperature detected at the detection end.

The free ends of each of the two conductor elements are connected to a corresponding transmission conductor, for transmitting an electric signal generated by the potential difference, which electric signal that switches from the open state to the closed state of the safety valve and vice versa.

BACKGROUND OF THE INVENTION

Systems are known in the art which use thermocouples for flame detection in gas burners, particularly domestic gas burners such as cooktop and ovens.

If there is a flame, the thermocouple generates a potential difference and hence a current strength at the ends of the cold junction, and the two ends are generally connected to an inductor which creates a force that moves the magnet of the safety valve for turning on and shutting off the gas supply.

Users of common cooktops manually excite such magnet to turn on gas supply, by applying a force on the cooktop knobs, whereupon a flame is created, the thermocouple detects the flame and generates a current that keeps the safety valve open, and the user may stop exerting force.

If the flame is blown out, the thermocouple ceases to generate current and the safety valve closes, thereby cutting off the gas flow.

This system apparently can have low manufacturing costs and be easily implemented, but only affords one burner safety control, i.e. can only check whether a flame is present.

The voltage generated at the ends of the cold junction is dependent on the materials that form the thermocouple, but is never more than a few microvolts per Celsius degree. Thus, the generated voltage is too low to be read, unless advanced amplification systems and appropriate calibrations are used.

As a result, the implementation of checks and control functions other than the simple "on/off" safety check as described above on prior art thermocouple systems is still difficult and expensive.

This prevents thermocouple systems from being used in modern electrical appliances, particularly ovens, in which temperature control and timing are critical requirements.

Therefore, there is still the need for a thermocouple-based flame ignition and control system, that allows implementation of controls such as temperature and cooking time controls.

SUMMARY OF THE INVENTION

The present invention fulfills such need by providing a flame detection system as described above, in which at least the operation of the igniter device is controlled according to the current strength of the electric signal.

This will allow the operation of the igniter device to be controlled by reading a control signal, which is measurable and is based on the current strength of the electric signal generated by the thermocouple.

In spite of the low potential difference value, i.e. a few microvolts per Celsius degree, the thermocouple affords optimal current availability, with current strength values that can reach hundreds of milliamperes.

Therefore, the current strength may be the control signal for the ignition electrode power supply means, which can control, for instance, current strength and current pulse transmission for flame ignition.

It shall be noted that, since the current strength so generated is proportional to heat and hence to the intensity of the flame and to the temperature developed thereby, then the flame ignition and control system of the present invention can be used in all heat energy generators, and allows simple and prompt flame detection and control as well as ascertainment of the flame state, thereby implementing check, control and safety features and others.

Applications of the flame ignition and control system include gas burners of ordinary domestic use in the field of cooking, heating, air conditioning, sanitary water applications, refrigeration and washing.

Therefore, the system of the present invention advantageously uses stable control signals, having appropriate electric values, which avoids the need for particular filter or isolation and/or amplification devices.

In one embodiment, a coil is connected in series with one of the two transmission conductors, the magnetic signal generated by the coil being detected by at least one sensor, which is adapted to convert the magnetic signal into an electric signal, whose current strength controls the operation of at least the igniter device.

The current strength of the electric signal, i.e. the control signal, is measured in this case by the provision of a coil and a sensor that can convert the magnetic field generated by the coil into a control signal, the latter being either an on/off signal or a variable signal, indicative of the flame state.

Furthermore, the flame ignition and control system of the present invention is fabricated in a very simple manner, as it simply requires the addition of a coil connected in series with known devices, such as the thermocouple and the safety valve, no other change being required.

The addition of a coil provides automatic safe isolation between the thermocouple, which is typically accessible by the user and directly connected to the ground of the apparatus, and the check and control circuit directly connected to the mains. Such isolation is obtained because the detection sensor is not electrically connected to the thermocouple and hence is separated from the thermocouple-coil circuit.

Finally, the use of the magnetic field and the sensor allows the system of the invention to operate at high temperatures, even at 150°, with no expensive arrangement, and with such temperatures not affecting the transmission and/or quality of the signal.

Therefore, the sensor may be connected to the ignition electrode power supply means to control, for instance, current strength and current pulse transmission for flame ignition.

Instead of or in addition to the above, the sensor may be connected to an electronic interface, which is in turn connected to one or more of the components of the flame ignition and control system of the present invention.

For instance, if temperature control is needed, the sensor might be connected to the flame control means, to automatically decrease of increase the intensity thereof.

In this case, the electric signal generated by the thermocouple, via the electronic interface, may be used to control and obtain all the features and checks to be implemented on the burner.

For instance, it can control an automatic flame ignition system or any control device that can be associated to the flame or its user.

The above configuration provides controls that could not be implemented heretofore on common electrical appliances that used gas burners.

For instance, the system of the present invention can provide an automatic ignition and re-ignition system for a low-temperature gas oven, which allows operation on a normal gas oven to minimize the power of the burner and hence the minimum operating temperature of the oven.

The minimum power of a gas oven burner is typically calibrated to a value ensuring that the burner will remain on even if the oven door is opened or of it is slammed closed. This value is typically 1.5 times to twice the minimum value afforded by the burner.

Au automatic ignition and reignition system implemented in an oven burner allows minimization of the operation power, and ensures reignition if the flame is blown out as the door is closed.

The electronic interface may be incorporated in each of the components of the system or be provided upstream from such components.

Also, the electronic interface may have either a single input for a control signal, which is later processed to obtain the checks and controls to be implemented, or a plurality of control signals obtained from corresponding sensors, so that each control signal identifies a check and/or control to be implemented.

Therefore, any kind of prior art sensor may be used, and multiple sensors may be provided for detecting the magnetic field generated by the coil.

The sensor to be used may be selected, for instance, according to the type of checks that the system of the invention is expected to make.

For example, reed magnetic sensors may be used in case of checks that require an on/off control signal, whereas Hall effect sensors, i.e. semiconductors whose resistance changes according to the magnetic field, are suitable to obtain proportional reading of the electric signal generated by the thermocouple.

In one embodiment, the coil is supported by an isolating support and has turns of conductive material, whose section does not alter the resistance of the transmission conductor with which the coil is connected.

The main purpose of the coil is to allow measurement of current strength and generation of corresponding control signals, without changing the potential difference at the ends of the cold junction, which is used to open/close the safety valve.

Therefore, the coil may be connected in series with one of the transmission conductors in any point of the circuit, although a preferred position may be considered as a function of the values to be detected.

Furthermore, as long as the coil is connected in series, it can be connected to any one of the transmission conductors, a variant embodiment consisting in that the turns of the coil are the windings of the transmission conductor.

Any construction improvement known in the art of magnetic fields can apply to the coil.

Particularly, in one embodiment, the coil has a magnetic flux concentrating core, for concentrating the magnetic field flux generated by the coil to a particular area, thereby improving signal detection by the sensor.

In one improvement, calibrating members are used in combination with the coil, which members may consist of a magnet or an additional coil and, when located in appropriate positions, allow reduction and/or calibration of the required flux and the hence the current generated by the thermocouple to control the sensor.

BRIEF DESCRIPTION OF THE DRAWINGS

These and other features and advantages of the invention will be more apparent from the following description of a few embodiments shown in the accompanying drawings, in which.

DETAILED DESCRIPTION OF EMBODIMENTS OF THE INVENTION

Figure 1:
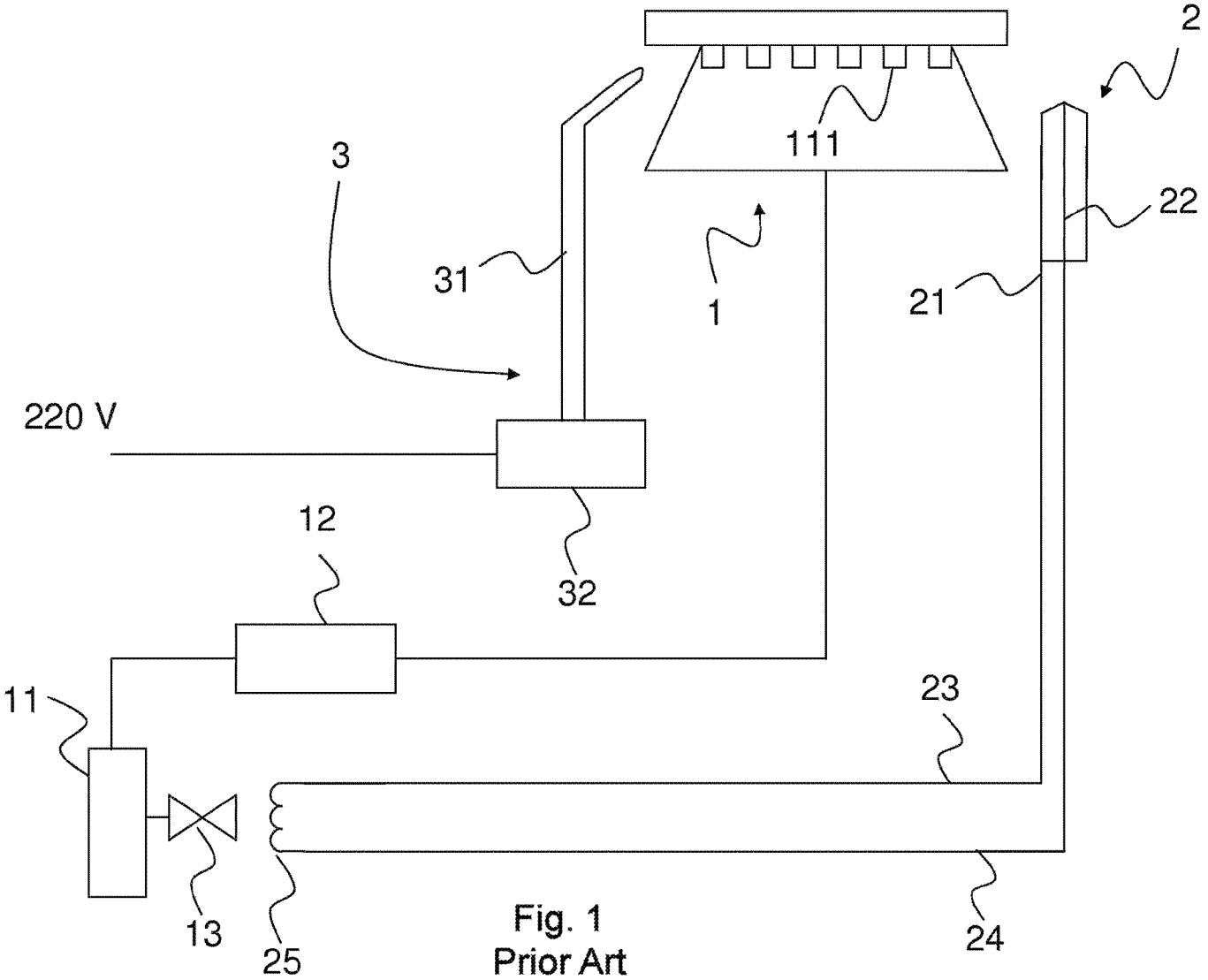
Fig. 1 Prior Art
FIG. 1 is a skeleton diagram of a prior art flame detection system.

FIG. 1 is a skeleton diagram of a prior art flame detection system.

The flame detection system comprises a gas burner 1 which is connected to a gas source 11 via flame control means 12 and a safety valve 13 controlled by a flame sensor consisting of a thermocouple 2.

The safety valve has an open state, in which the gas source 11 supplies gas to the burner 1, and a closed state in which gas flow is obstructed, to prevent flame formation and gas leakage from the nozzles 111 of the burner 1.

Furthermore, an igniter device 3 is provided, which consists of an ignition electrode 31 and power supply means 32 therefor, such that the power supply means 32 send current pulses to the ignition electrode 31 to generate a spark at the nozzles 111 of the burner 1.

The power supply means 32 are also connected to the mains.

The thermocouple 2 comprises a first conductor element 21 and a second conductor element 22, which first and second conductor elements 21 and 22 are in electrically conductive contact at one detection end, known as hot junction, which is obtained by joining a terminal of said first conductor element 21 and a corresponding terminal of the second conductor element 22, to generate a potential difference at the two free ends of each conductor element, known as cold junction, which is a function of the temperature detected at the detection end.

The free ends of each of the two conductor elements 21 and 22 are connected to a corresponding transmission conductor 23 and 24 for transmitting the electric signal generated by the potential difference.

The terminals of the transmission conductors 23 and 24 are connected to an inductor 25, through which the electric signal flows and creates an electromotive force that excites the magnet of the safety valve 13, whose movement shuts off or turns on the gas supply 11.

Therefore, the electric signal generated by the thermocouple 2 is the control signal that switches from the open state to the closed state of the safety valve 13 and vice versa.

The flame control means typically consist of control knobs, that are pressed and rotated by the user to excite the magnet of the safety valve 13 for the latter to move to an open state, thereby allowing gas supply to the burner 1, to trigger the ignition electrode 31 which is powered by the power supply means 32 for flame ignition and to control flame intensity.

Once the flame is on, any temperature variation at the detection head of thermocouple 2 turns into an electric signal that flows into the conductor elements 21 and 22 and the transmission conductors 23 and 24.

The electric signal generates a potential difference at the ends of the inductor 25, which keeps the magnet of the safety vale 13 open, thereby allowing the user to stop his/her action on the flame control means 12.

If the flame is blown out, the thermocouple 2 detects a decrease in temperature at the detection head, which is turned into a corresponding electric signal that allows the safety valve 13 to close.

Figure 2A:
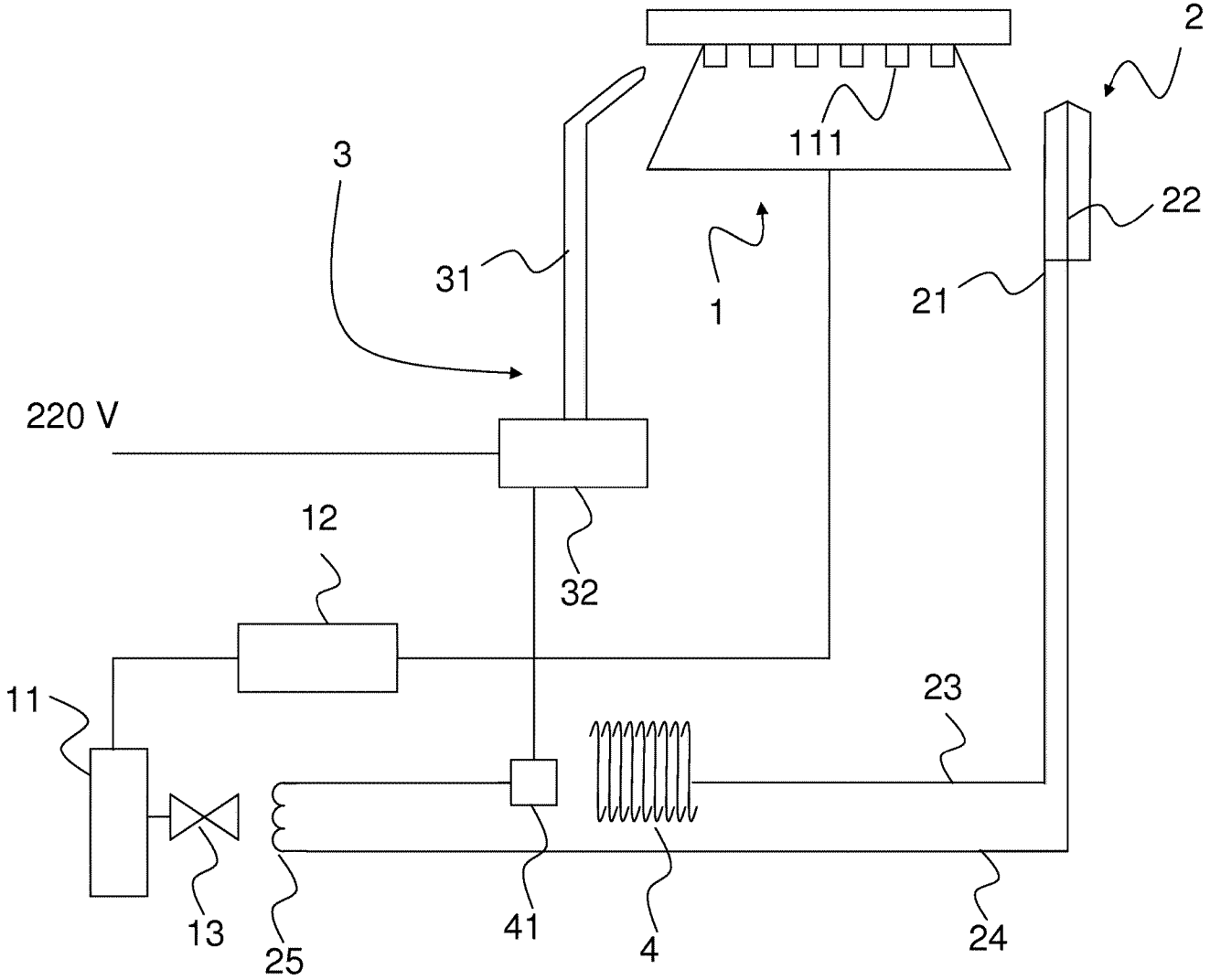
FIGS. 2*a* and 2*b* are skeleton diagrams of a flame ignition and control system of the present invention, according to two different embodiments.
Figure 2B:
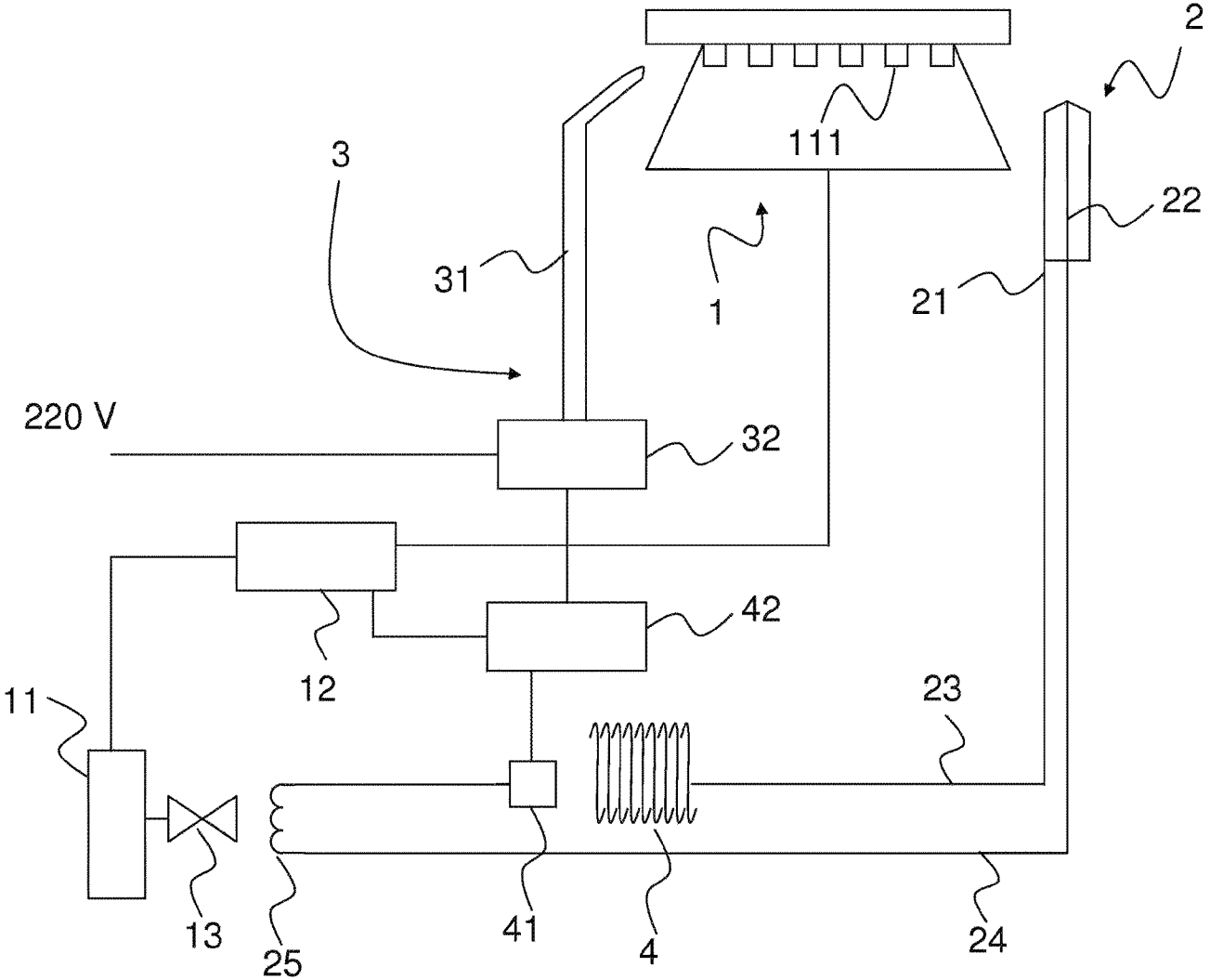

FIGS. 2*a* and 2*b* are skeleton diagrams of a flame ignition and control system of the present invention.

Particularly, the system of FIGS. 2*a* and 2*b* is similar to the prior art flame detection system as shown in FIG. 1, in which at least the operation of the igniter device 3 is controlled according to the current strength of the electric signal.

Particularly referring to FIG. 2*a*, a coil 4 is connected in series with the transmission conductor 23, and the electric signal flows therethrough to generate a magnetic field which is detected by a sensor 41 connected to the power supply means 32 for the ignition electrode 31.

The sensor 41 turns the magnetic field so detected into a corresponding electric signal, which is the control signal for controlling the operation of the igniter device 3.

In FIG. 2*a*, the sensor 41 is connected to the power supply means 32 to control the operation of the igniter device 3, i.e. by determining how current pulses are transmitted to the electrode 31.

Depending on the desired flame controls, various connections may be provided for the sensor 41, e.g. the sensor 41 may be connected to the flame control means 21 if temperature control is desired.

Thus, the sensor 41 may be connected to all the components of the flame ignition and control system.

The coil 4 is connected in series with the transmission conductor 23, but it can be connected to any one of the two transmission conductors 23 and 24.

In a further embodiment, two coils 4 may be provided, one for each transmission conductor 23 and 24, with two corresponding sensors 41 for generating two different control signals, which can be transmitted to different components of the flame ignition and control system of the present invention.

Here, particular arrangements are required to prevent the magnetic field of a coil from interfering with the detection by the sensor 41 coupled to the other coil, such that the two control signals are distinct signals.

FIG. 2*b* shows a variant embodiment of the flame ignition and control system of the present invention, whose features may be provided in addition to or instead of the features as described with reference to FIG. 2*a*.

In this embodiment, the sensor 41 is connected to an electronic interface 42, which is connected to the components of the system of the present invention.

In the particular case of FIG. 2*b*, an interface controller 42 transmits control signals both to the flame control means 12 and to the power supply means 32 for the electrode 31, to check and control both temperature and the on and off states of the burner 1.

Furthermore, the electronic controller 42 is separate from the various components of the system of the invention, but may be incorporated in such components, which directly receive the signal from the sensor 41.

If various control signals are needed to provide different checks and controls, each control signal may have an input and a corresponding output associated therewith, or a single input may be provided for a single signal, which is processed in the interface controller 42 for information to be extracted from said signal as required to implement the desired checks and controls.

Therefore a processing unit shall be provided in the controller 42, which unit has processor means for executing logic programs which allow both signal processing and programming of the operation of the burner 1, e.g. timing for turning it on and off.

As better explained below, the coil 4 may be associated with various sensors 41, differing both in type, to allow differentiated signal detection, and in number, to implement any number of controls.

Figure 3A:
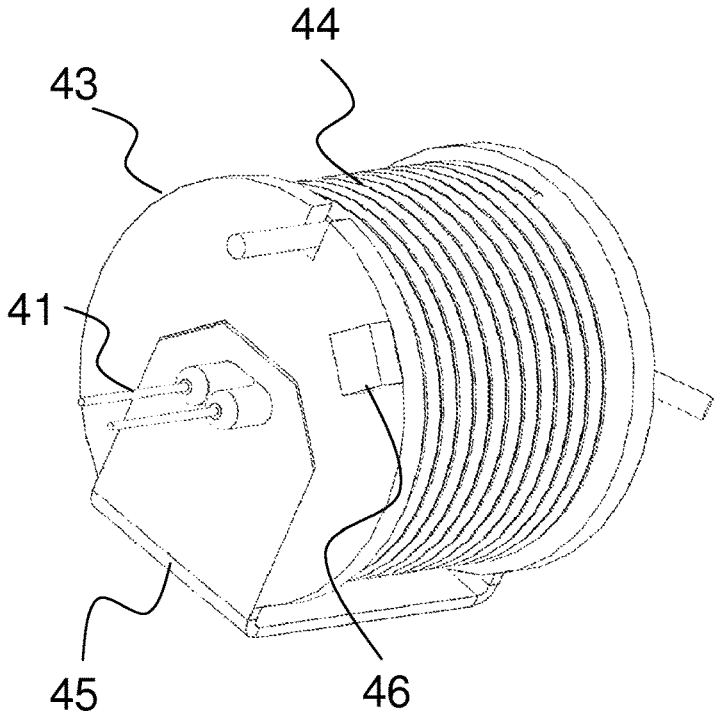
FIGS. 3*a* and 3*b* are two views of the coil of the inventive system, according to two different embodiments.
Figure 3B:
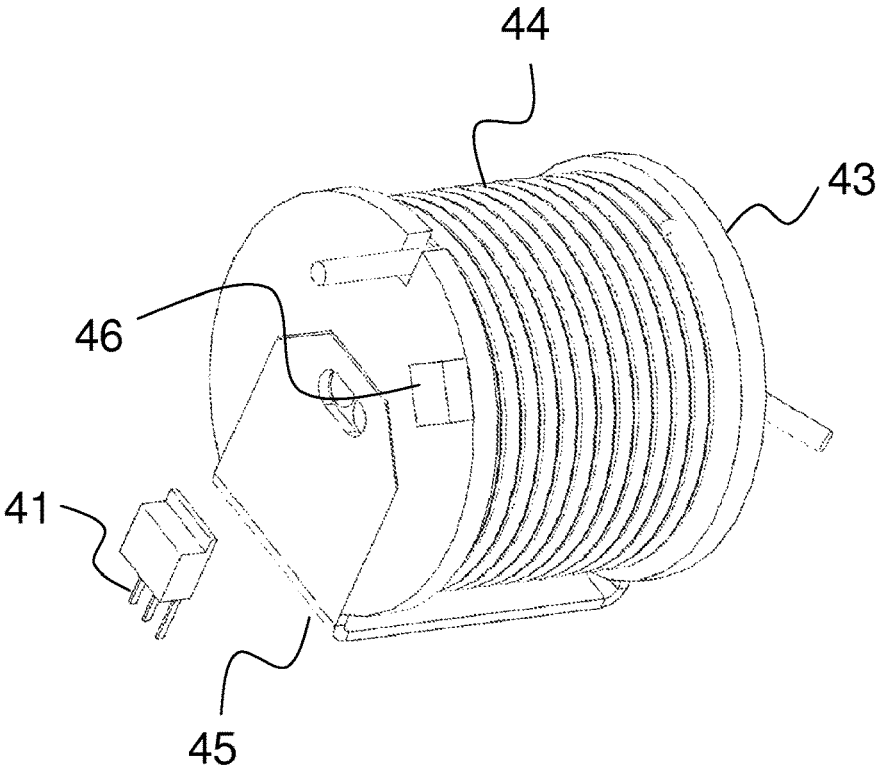

FIGS. 3*a* and 3*b* show two views of the coil 4 of the inventive system, according to two possible different embodiments.

Particularly referring to FIGS. 3*a* and 3*b*, the coil 4 is supported by an isolating support member 43 and has turns 44 of conductive material, whose section does not alter the resistance of the transmission conductor with which the coil 4 is connected.

Furthermore, a magnetic flux concentrating core 45 and calibrating members 46 are provided in combination with the coil 4 of FIGS. 3*a* and 3*b*, for controlling the magnetic flux detected by the sensor 41.

Both the magnetic flux concentrating core 45 and the calibrating members 46 are permeated by the magnetic field of the coil 4, but do not contact the turns 44 due to the presence of the isolating support member 43.

In a possible variant embodiment, the turns 44 of the coil 4 may be the windings of the transmission conductor 23 or 24 with which the coil 4 is connected.

Referring to FIG. 3*a*, the sensor 41 consists of a reed sensor, and particularly two reed sensors are provided which implement, as described above, two different controls.

Particularly referring to FIG. 3*b*, the sensor 41 is a Hall effect sensor, as is known in the art.

The invention claimed is:

1. A flame ignition and control system, comprising:

a gas burner (1) connected to a gas source (11) via a flame control system (12) and to a safety valve (13), which is controlled by a flame sensor comprising a thermocouple (2), said safety valve (13) having an open state, in which said gas source (11) supplies gas to said gas burner (1), and a closed state, in which gas flow is obstructed; and an igniter device (3) comprising an ignition electrode (31) and a power supply (32) therefor, said power supply (32) sending current pulses to said ignition electrode (31) to generate a spark at nozzles (111) of said gas burner (1), said thermocouple (2) comprising a first conductor element (21) and a second conductor element (22), wherein said first (21) and second (22) conductor elements are in electrically conductive contact at one detection end providing a hot junction, said hot junction being obtained by joining a terminal of said first conductor element (21) and a corresponding terminal of said second conductor element (22) to generate a potential difference at free ends of said first and said second conductor element (21, 22) that provide a cold junction, said cold junction being a function of a temperature detected at the detection end, wherein the free ends of each of said first and said second conductor elements (21, 22) are connected to a corresponding transmission conductor (23, 24) of two transmission conductors for transmitting a first electric signal generated by said potential difference, said first electric signal being received by an inductor coil (25) that causes the safety valve (13) to switch from the open state to the closed state and vice versa, further comprising a second coil (4) that is connected in series with one of the two transmission conductors (23, 24), a magnetic signal generated by said second coil (4) being detected by a second sensor (41), which converts said magnetic signal into a second electric signal that controls operation of said igniter device (3) and of said flame control system (12), wherein at least operation of said igniter device (3) is controlled according to current strength of said second electric signal, wherein operation of the flame control system (12) is controlled according to current strength of said second electric signal for automatically increasing or decreasing flame intensity, thereby controlling flame temperature, and wherein said second sensor comprises one or more second sensors (41), at least one of said one or more second sensors being a Hall effect magnetic sensor.

2. The flame ignition and control system as claimed in claim 1, wherein said second electric signal is received by said power supply (32) for said ignition electrode (3), thereby causing control of said igniter device (3).

3. The flame ignition and control system as claimed in claim 1, wherein said second electric signal is received by an electronic interface (42), the electronic interface (42) being connected to one or more components of said flame ignition and control system.

4. The flame ignition and control system as claimed in claim 1, wherein said second coil (4) is supported by an insulating support member (43) and has turns (44) of conductive material, said turns (44) having a section that does not alter a resistance of one of the two transmission conductors (23, 24) with which said coil (4) is connected.

5. The flame ignition and control system as claimed in claim 4, wherein said second coil (4) has a magnetic flux concentrating core (45).

6. The flame ignition and control system as claimed in claim 4, further comprising means for calibrating (46) that are provided in combination with said second coil (4), said means for calibrating (46) controlling a magnetic flux detected by said second sensor (41).

7. The flame ignition and control system as claimed in claim 4, wherein said turns (44) of said second coil (4) are windings of the one of the two transmission conductors (23, 24).

* * * * *